US006349566B1

(12) United States Patent
Howard et al.

(10) Patent No.: US 6,349,566 B1
(45) Date of Patent: Feb. 26, 2002

(54) DEPHLEGMATOR SYSTEM AND PROCESS

(75) Inventors: Lee Jarvis Howard, Pikeville; Howard Charles Rowles, Center Valley; Randy James Nickel, Allentown; Gene Anthony Lucadamo, Macungie; Bruce Moodie Hill, Whitehall, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/663,477

(22) Filed: Sep. 15, 2000

(51) Int. Cl.[7] ..... F25J 1/00
(52) U.S. Cl. ..... 62/627; 62/903; 165/166
(58) Field of Search ..... 62/627, 903; 165/166

(56) References Cited

U.S. PATENT DOCUMENTS

| | | | | |
|---|---|---|---|---|
| 3,568,461 A | | 3/1971 | Hoffman | 52/42 |
| 3,568,462 A | | 3/1971 | Hoffman et al. | 62/42 |
| 3,612,494 A | | 10/1971 | Toyama et al. | 261/112 |
| 3,983,191 A | | 9/1976 | Schauls | 261/114 |
| 3,992,168 A | | 11/1976 | Toyama et al. | 62/42 |
| 4,330,308 A | | 5/1982 | Grenier et al. | 62/40 |
| 4,519,825 A | | 5/1985 | Bernhard et al. | 62/28 |
| 4,525,187 A | | 6/1985 | Woodward et al. | 62/31 |
| 4,599,097 A | | 7/1986 | Petit et al. | 62/36 |
| 4,606,745 A | | 8/1986 | Fujita | 62/42 |
| 4,732,598 A | | 3/1988 | Rowles et al. | 62/28 |
| 4,749,393 A | * | 6/1988 | Rowles et al. | 62/627 |
| 5,017,204 A | | 5/1991 | Gottier et al. | 62/11 |
| 5,071,458 A | | 12/1991 | Grenier et al. | 62/62 |
| 5,144,809 A | | 9/1992 | Chevalier et al. | 62/36 |
| 5,207,065 A | | 5/1993 | Lavin et al. | 62/11 |
| 5,321,954 A | | 6/1994 | Lehman et al. | 62/36 |
| 5,329,775 A | | 7/1994 | Fiedler et al. | 62/24 |
| 5,333,683 A | | 8/1994 | Arriulou et al. | 165/166 |
| 5,361,589 A | | 11/1994 | Howard et al. | 62/24 |
| 5,377,490 A | | 1/1995 | Howard et al. | 62/23 |
| 5,379,597 A | | 1/1995 | Howard et al. | 62/23 |
| 5,385,203 A | | 1/1995 | Mitsuhashi et al. | 165/110 |
| 5,592,832 A | | 1/1997 | Herron et al. | 62/646 |
| 5,596,883 A | | 1/1997 | Bernhard et al. | 62/618 |
| 5,634,354 A | | 6/1997 | Howard et al. | 62/624 |
| 5,765,631 A | | 6/1998 | Gerard | 165/166 |
| 5,802,871 A | | 9/1998 | Howard et al. | 62/627 |
| 5,899,093 A | | 5/1999 | Ha | 62/643 |
| 5,956,972 A | * | 9/1999 | Naumovitz | 62/903 |
| 5,983,665 A | | 11/1999 | Howard et al. | 62/623 |
| 6,128,920 A | * | 10/2000 | Matsuo et al. | 165/166 |

FOREIGN PATENT DOCUMENTS

| | | | |
|---|---|---|---|
| JP | 10197169 | 7/1998 | F28B/1/02 |
| JP | 11244603 | 9/1999 | B01D/3/02 |

OTHER PUBLICATIONS

Altec® Core in Kettle® Product Brochure, Altec International 1992.

* cited by examiner

*Primary Examiner*—Ronald Capossela
(74) *Attorney, Agent, or Firm*—John M. Fernbacher

(57) ABSTRACT

Dephlegmator system without headers, collectors, or distributors at the bottom end of feed circuits in plate and fin exchangers operating in condensing or rectifying service. Each dephlegmator is installed within a pressure vessel, thereby eliminating the need for headers, collectors, or distributors at the bottom end of the feed circuits. In an alternative embodiment of the invention, upper and lower segments of the pressure vessel are isolated by a mid-vessel seal between the vessel and dephlegmator walls, and headers or collectors are not required at the upper and lower ends of the feed circuits.

17 Claims, 4 Drawing Sheets

DEPHLEGMATOR SYSTEM AND PROCESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Dephlegmators are widely used in the process industries for the separation of gas mixtures, particularly those which contain components with sub-ambient boiling points. Such separations require significant amounts of low temperature refrigeration and are thus highly energy intensive. Dephlegmators offer simple, reliable, and efficient operation for such gas separations.

The characteristic feature of dephlegmator operation is the utilization of simultaneous heat and mass transfer in a group of generally vertical flow channels or passageways in indirect heat transfer communication with other flow channels containing heating or cooling fluids. A dephlegmator thus combines both heat transfer and mass transfer in a single operating system. Heat and mass transfer in process streams within dephlegmator channels can occur in either a condensation or vaporization mode.

In the condensation or rectification mode of operation, a feed gas mixture is cooled and partially condensed within a group of flow channels by indirect heat transfer with one or more refrigerants or colder fluids flowing in adjacent channels. The resulting condensed liquid flows downward while exchanging heat and mass with the remaining vapor, which flows upward. A liquid stream enriched in higher boiling components and a vapor stream enriched in lower boiling components are withdrawn from the feed flow channels. Rectification occurs in this operation, and a dephlegmator operating in this mode is often called a rectifying condenser or rectifying dephlegmator. This type of dephlegmator can be used for rejecting nitrogen from natural gas (U.S. Pat. Nos. 4,732,598 and 5,802,871), producing refrigerated liquid methane (U.S. Pat. No. 5,983,665), recovering helium from natural gas (U.S. Pat. Nos. 5,017,204 and 5,329,775), purifying synthesis gas (U.S. Pat. No. 4,525,187), recovering $C_4^+$ hydrocarbons (U.S. Pat. No. 4,519,825), and for recovering olefins from hydrocarbon-hydrogen mixtures such as cracked gases, refinery offgases, and petrochemical plant offgases (U.S. Pat. Nos. 5,361,589, 5,377,490, 5,379,597, and 5,634,354).

In the vaporization or stripping mode of operation, a liquid feed mixture is heated and partially vaporized within a group of flow channels by indirect heat transfer with one or more warmer fluids flowing in adjacent channels. The vaporizing liquid flows downward while exchanging heat and mass with the generated vapor, which flows upward. Stripping action is promoted by the upward flowing vapor. A liquid stream enriched in higher boiling components and a vapor stream enriched in lower boiling components are withdrawn from the feed channels. This type of dephlegmator, often called a stripping dephlegmator, is described in representative U.S. Pat. No. 5,596,883.

Some condensing type dephlegmators utilize an upward-flowing boiling liquid to provide refrigeration in a group of flow channels which remove heat by indirect heat exchange from a condensing stream in adjacent channels. The refrigeration channels are open at the lower end, and usually at the upper end as well, and the dephlegmator may be partly or completely submerged in the boiling liquid. This type of refrigeration circuit is called a thermosiphon heat exchanger and is discussed further below.

A combined mode of operation also is possible in which a vapor is condensed in a first group of flow channels while a liquid is vaporized in a second group of channels, wherein the first and second groups of channels are in heat transfer communication. Heat to vaporize the liquid in the second group of channels is provided by the condensing vapor in the first group of channels, rectification occurs in the first group of channels, and stripping occurs in the second group of channels. This type of dual-mode dephlegmator is used for air separation as described in U.S. Pat. Nos. 5,592,832 and 5,899,093.

Dephlegmators are constructed with multiple flow channels or passageways which are grouped and manifolded to segregate process stream(s) from heating or cooling stream (s) while allowing indirect heat transfer between the streams. More than two groups of channels can be used to process multiple streams in the same dephlegmator. Plate and fin heat exchangers, also known as core-type exchangers, are widely preferred for dephlegmator service. These are typically of brazed aluminum construction, but any appropriate metals can be used. Shell and tube heat exchangers have utility as dephlegmators, but are less favored than the plate and fin configuration.

In the operation of dephlegmators used for the separations described above, the proper distribution of the process feed stream into the multiple flow channels and the withdrawal of vapor and/or liquid product streams from the multiple flow channels are necessary for efficient operation. Of particular importance in a widely-used type of condensing dephlegmator described below is the proper introduction of feed gas into the bottom end of a group of flow channels while withdrawing condensate from the bottom end of the same flow channels.

Several methods have been proposed to introduce feed vapor into and remove condensed liquid from the bottom of a brazed aluminum, core-type dephlegmator. U.S. Pat. Nos. 5,333,683, 3,992,168, 3,983,191 and 3,612,494 disclose the use of two separate headers, one for the vapor to enter the bottom of the dephlegmator core and the other for the liquid to drain from the bottom of the core. These designs require distribution fins, both to distribute the vapor into the core and to collect the liquid draining from the core. These distribution fins, particularly the vapor distribution fins, reduce the fluid-handling capacity of the core below that which could otherwise be attained in the full cross-section of heat/mass transfer flow channels used in the main body of the dephlegmator core.

U.S. Pat. Nos. 5,144,809, 3,568,462 and 3,568,461 show the use of integral dome headers which enclose the entire bottom end of the dephlegmator core and allow vapor to enter the core and liquid to drain from the core without obstruction. However, to have adequate mechanical strength, these dome headers are restricted to relatively low pressure applications or cores of relatively small cross-section.

Other methods have been proposed to separate vapor and liquid exiting a conventional core-type heat exchanger or for the input or output of fluids from core-type heat exchangers.

U.S. Pat. Nos. 5,765,631, 5,321,954 and 4,599,097 show various types of integral domes and other integrated vessels which can be used primarily to separate mixtures of vapor and liquid entering or leaving a conventional core-type heat exchanger in order to individually distribute them into the core or remove them from the core. Some of these devices alternatively could be used for input or output of fluids from dephlegmator cores, but they are also restricted to use in relatively low-pressure applications or with cores of relatively small cross-section.

U.S. Pat. No. 5,385,203 discloses a conventional core-type heat exchanger mounted inside a partitioned vessel such that the several separate chambers formed by the partitions provide a multi-stage thermosiphon-type heat exchanger with different boiling refrigerants in each of the separate chambers. Circulation of the boiling refrigerants is obtained by the submergence of appropriate sections of the core in the refrigerant liquids contained within each of the chambers. The thermosiphon boiling refrigerants in the open circuits of the core serve to cool a process gas stream contained within a closed circuit of the core.

Integral domes and other vessels mounted on a conventional core-type heat exchanger as shown in U.S. Pat. No. 4,330,308 provide a similar multi-stage thermosiphon-type heat exchanger with different boiling refrigerants in each of the separate sections of the core. Circulation of the boiling refrigerants is obtained by the submergence of appropriate sections of the core in the refrigerant liquids contained within each of the sections of the core. Other dome-type integrated vessels are shown to introduce a vapor/liquid refrigerant mixture into the core heat exchanger. These devices are also restricted to use in relatively low-pressure applications or with cores of relatively small cross-section.

These thermosiphon-type heat exchanger core assemblies are analogous to a series of kettle-type shell and tube heat exchangers used to cool a process stream in the tube circuit by means of a boiling refrigerant in the enlarged, or kettle-type, shell. Altec International, La Crosse, Wis., manufactures similar brazed aluminum Core-in-Kettle™ heat exchangers for use in place of kettle-type shell and tube heat exchangers.

U.S. Pat. Nos. 5,071,458 and 4,606,745 describe air separation plant reboiler-condenser core-type heat exchangers which are installed inside distillation columns. These cores are at least partially submerged in liquid oxygen refrigerant to provide the driving force for the thermosiphon boiling of the oxygen in a low pressure column, typically operating below 30 psia, which serves to condense nitrogen vapor from a higher pressure column.

The efficient operation of core-type dephlegmators requires that the feed gas mixture entering a group of flow channels be evenly distributed so that the entire cross-section of the dephlegmator is fully utilized. Maldistribution will reduce the efficiency of a dephlegmator, thereby decreasing the degree of separation.

In a rectifying core-type dephlegmator which operates in the condensing mode, feed gas is introduced into the bottom end of a group of flow channels while condensate is withdrawn from the bottom end of the same flow channels. In the prior art described above, headers and distributor devices are required for the distribution of feed gas and collection of condensed liquid. The present invention described and defined below is an improved dephlegmator design which does not require headers and distributors at the lower end, and optionally at the upper end, of the dephlegmator core. This promotes efficient utilization of the entire core cross-section for heat and mass transfer without the flow restrictions caused by distributors and headers.

BRIEF SUMMARY OF THE INVENTION

The invention is a system for the separation of a feed gas mixture containing at least one more volatile component and at least one less volatile component, which system comprises:

(a) a pressure vessel having an interior and an exterior;

(b) a dephlegmator installed in the interior of the pressure vessel, wherein the dephlegmator comprises a group of flow passageways, each passageway having an upper end and a lower end, and wherein the lower ends of the flow passageways are open and are in flow communication with the interior of the pressure vessel;

(c) at least one vapor header in flow communication with the upper ends of the flow passageways, and piping means for withdrawing a vapor product enriched in the more volatile component from the vapor header to the exterior of the pressure vessel;

(d) piping means for introducing the feed gas mixture into the interior of the pressure vessel; and (e) piping means for withdrawing from the interior of the pressure vessel a liquid product enriched in the less volatile component.

The system can further comprise:

(f) one or more additional groups of flow passageways in the dephlegmator wherein each of the flow passageways has an upper end and a lower end, and wherein the group of additional flow passageways is in indirect heat transfer communication with the group of flow passageways of (b);

(g) an upper header in flow communication with the upper ends of the flow passageways of (f) and a lower header in flow communication with the lower ends of the flow passageways of (f); and (h) piping means for introducing refrigerant from the exterior of the pressure vessel into one header of (g) and piping means for withdrawing refrigerant from the other header of (g) to the exterior of the pressure vessel.

The dephlegmator can be constructed in a plate and fin configuration or in a shell and tube configuration.

Optionally, the system can further comprise one or more additional dephlegmators installed in the pressure vessel and configured to operate in parallel with the dephlegmator of (b) above.

In another embodiment, the system can further comprise:

(f) an additional pressure vessel having an interior and an exterior;

(g) an additional dephlegmator installed in the interior of the additional pressure vessel, wherein the additional dephlegmator comprises a group of flow passageways, each passageway having an upper end and a lower end, and wherein the lower ends of the flow passageways are open and are in flow communication with the interior of the additional pressure vessel;

(h) at least one vapor header in flow communication with the upper ends of the flow passageways, and piping means for withdrawing a vapor product further enriched in the more volatile component from the vapor header to the exterior of the additional pressure vessel;

(i) piping means for transferring the vapor product of (c) from the pressure vessel of (a) into the interior of the additional pressure vessel of (f); and (j) piping means for withdrawing from the interior of the additional pressure vessel an additional liquid product enriched in the less volatile component.

In an alternative embodiment, the system can further comprise:

(k) one or more groups of additional flow passageways in the additional dephlegmator wherein each of the flow passageways has an upper end and a lower end, and wherein the group of additional flow passageways is in indirect heat transfer communication with the group of flow passageways of (g);

(l) an upper header in flow communication with the upper ends of the flow passageways of (k) and a lower header in flow communication with the lower ends of the flow passageways of (k); and (m) piping means for introducing refrigerant from the exterior of the additional pressure vessel into one header of (1) and piping means for withdrawing refrigerant from the other header of (1) to the exterior of the additional pressure vessel.

The invention also includes a system for the separation of a feed gas mixture containing at least one more volatile component and at least one less volatile component, which system comprises:

(a) a pressure vessel having an interior and an exterior;

(b) a dephlegmator installed in the interior of the pressure vessel, wherein the dephlegmator comprises a group of flow passageways, each passageway having an upper end and a lower end, and wherein the upper and lower ends of the flow passageways are open and are in flow communication with the interior of the pressure vessel;

(c) seal means disposed in the pressure vessel at an axial location between the upper and lower ends of the flow passageways wherein the seal means divides the interior of the pressure vessel into an upper section and a lower section which are not in flow communication, wherein the upper ends of the flow passageways are in flow communication with the upper section of the pressure vessel and the lower ends of the flow passageways are in flow communication with the lower section of the pressure vessel;

(d) piping means for introducing the feed gas mixture into the lower section of the pressure vessel;

(e) piping means for withdrawing a vapor product enriched in the more volatile component from upper section of the pressure vessel; and (f) piping means for withdrawing from the lower section of the pressure vessel a liquid product enriched in the less volatile component.

The system can further comprise;

(g) one or more additional groups of flow passageways in the dephlegmator wherein the each of the flow passageways has an upper end and a lower end, and wherein the group of additional flow passageways is in indirect heat transfer communication with the group of flow passageways of (b);

(h) an upper header in flow communication with the upper ends of the flow passageways of (g) and a lower header in flow communication with the lower ends of the flow passageways of (g); and (i) piping means for introducing refrigerant from the exterior of the pressure vessel into one header of (h) and piping means for withdrawing refrigerant from the other header of (h) to the exterior of the pressure vessel.

The dephlegmator can be constructed in a plate and fin configuration or in a shell and tube configuration.

Alternatively, the system can further comprise an additional dephlegmator installed in the pressure vessel and configured to operate in parallel with the dephlegmator of (b).

In another embodiment, the system can further comprise:

(g) an additional pressure vessel having an interior and an exterior;

(h) an additional dephlegmator installed in the interior of the additional pressure vessel, wherein the dephlegmator comprises a group of flow passageways, each passageway having an upper end and a lower end, and wherein the upper and lower ends of the flow passageways are open and are in flow communication with the interior of the pressure vessel;

(i) seal means disposed in the additional pressure vessel at an axial location between the upper and lower ends of the flow passageways, which seal means divides the interior of the additional pressure vessel into an upper section and a lower section which are not in flow communication, wherein the upper ends of the flow passageway are in flow communication with the upper section of the pressure vessel and the lower ends of the flow passageways are in flow communication with the lower section of the pressure vessel;

(j) means for transferring the vapor product of (e) from the upper section of the pressure vessel into the lower section of the additional pressure vessel;

(k) piping means for withdrawing a vapor product further enriched in the more volatile component from upper section of the additional pressure vessel; and (l) piping means for withdrawing from the lower section of the additional pressure vessel a liquid product enriched in the less volatile component.

The invention also is a method for the separation of a feed gas mixture containing at least one more volatile component and at least one less volatile component which comprises:

(a) providing a pressure vessel having an interior and an exterior;

(b) providing a dephlegmator installed in the interior of the pressure vessel, wherein the dephlegmator comprises a group of flow passageways, each passageway having an upper end and a lower end, and wherein the lower ends of the flow passageways are open and are in flow communication with the interior of the pressure vessel;

(c) introducing the feed gas mixture into the interior of the pressure vessel;

(d) passing the feed gas mixture upwardly through the flow passageways and condensing therein at least a portion of the less volatile components by indirect heat transfer with one or more refrigerants, wherein the condensate so formed flows downward in heat and mass transfer relation with upward flowing vapor and collects in the bottom of the pressure vessel;

(e) providing at least one vapor header in flow communication with the upper ends of the flow passageways and withdrawing a vapor product enriched in the more volatile component from the vapor header to the exterior of the pressure vessel; and (f) withdrawing from the interior of the pressure vessel a liquid product enriched in the less volatile component.

The feed gas can comprise two or more components selected from the group consisting of hydrogen, helium, nitrogen, carbon monoxide, carbon dioxide, oxygen, and hydrocarbons having from one to six carbon atoms.

In another embodiment, the invention is a method for the separation of a feed gas mixture containing at least one more volatile component and at least one less volatile component which comprises:

(a) providing a pressure vessel having an interior and an exterior;

(b) providing a dephlegmator installed in the interior of the pressure vessel, wherein the dephlegmator comprises a group of flow passageways, each passageway having an upper end and a lower end, and wherein the upper and lower ends of the flow passageways are open and are in flow communication with the interior of the pressure vessel;

(c) providing seal means disposed in the pressure vessel at an axial location between the upper and lower ends of the flow passageways wherein the seal means divides the interior of the pressure vessel into an upper section and a lower section which are not in flow communication, wherein the upper ends of the flow passageways are in flow communication with the upper section of the pressure vessel and the lower ends of the flow passageways are in flow communication with the lower section of the pressure vessel;

(d) introducing the feed gas mixture into the lower section of the pressure vessel;

(e) passing the feed gas mixture upwardly through the flow passageways and condensing therein at least a portion of the less volatile component by indirect heat transfer with one or more refrigerants, wherein the condensate so formed flows downward in heat and mass transfer relation with upward flowing vapor and collects in the bottom of the pressure vessel;

(f) withdrawing a vapor product enriched in the more volatile component from upper section of the pressure vessel; and (g) withdrawing a liquid product enriched in the less volatile component from the lower section of the pressure vessel.

The feed gas ion this embodiment can comprise two or more components selected from the group consisting of hydrogen, helium, nitrogen, carbon monoxide, carbon dioxide, oxygen, and hydrocarbons having from one to six carbon atoms.

DETAILED DESCRIPTION OF THE INVENTION

Dome headers and similar integrated vessels can be used on brazed aluminum core-type dephlegmators up to about 3 feet by 4 feet in cross-section which typically operate at up to about 150 psig design pressure. In larger core-type dephlegmators or those operating at higher pressures, one or more headers with associated distributor sections (distribution fins), nozzles, and manifolds must be used on the bottom of the dephlegmator core to introduce the feed gas uniformly into the dephlegmator and remove the condensed liquid from the dephlegmator. These distributors and headers reduce the available flow area and thus the fluid-handling capacity of the dephlegmator. This reduction can be as much as 25 to 35% of the total potential heat and mass transfer capacity of the fin section in the main body of the dephlegmator core.

Figure 1:
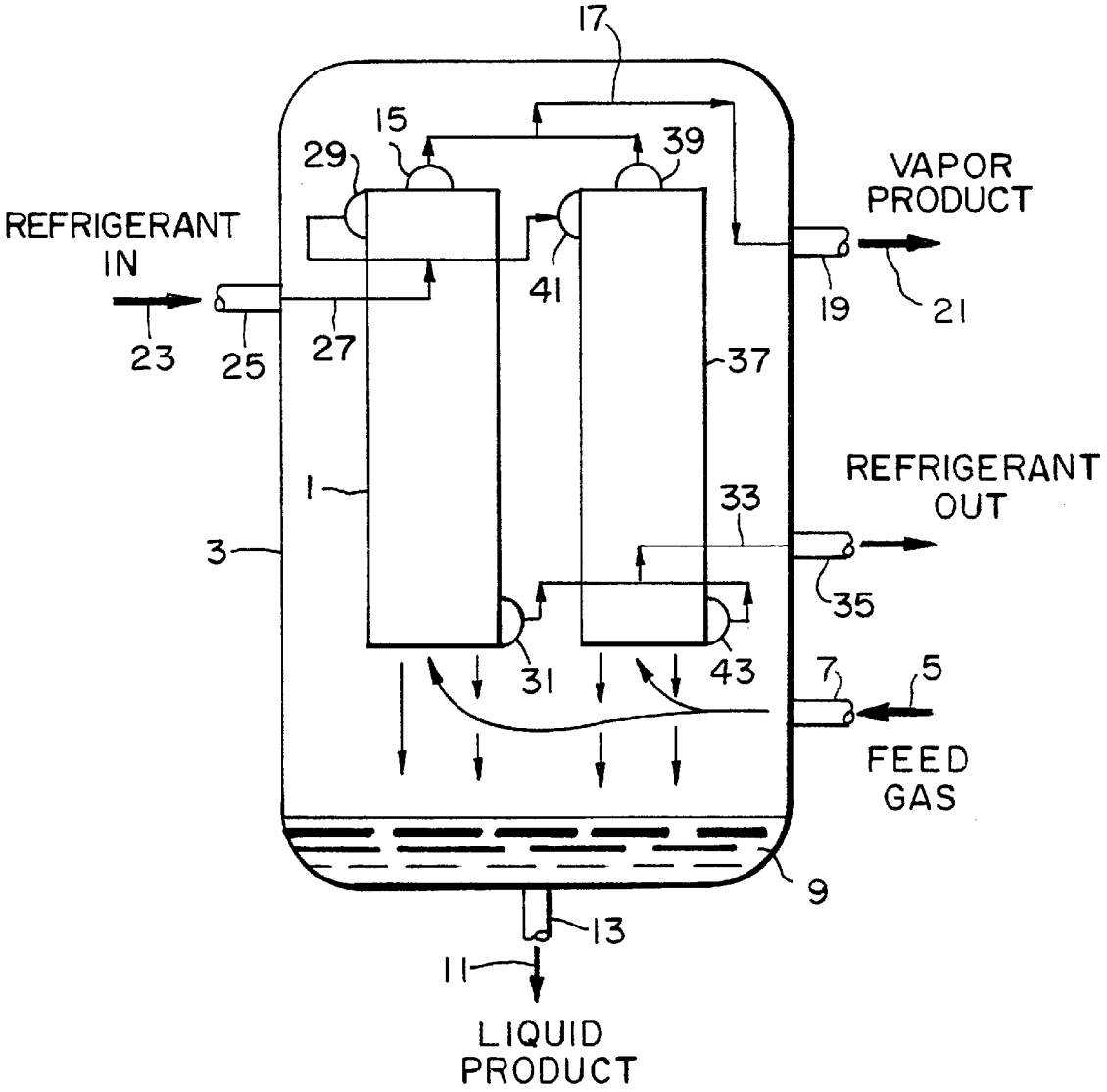
FIG. 1 is a schematic illustration of an embodiment of a dephlegmator according to the present invention.

In the present invention, one or more open-ended dephlegmator cores are installed inside of a pressure vessel, thereby eliminating the need for feed gas distributors, manifolds, and headers at the bottom of the dephlegmator. A first embodiment of the invention is illustrated in FIG. 1. Dephlegmator 1 preferably is a coretype plate and fin heat exchanger, and preferably is installed in a generally vertical configuration inside pressure vessel 3. A portion of the flow passageways in the dephlegmator is utilized for condensing service, and these passageways form a feed circuit in which feed gas flows upward while condensate flows downward. The flow passageways are preferably vertical, although they can deviate from vertical as long as vapor can flow upward and liquid can flow downward countercurrently. Typically, the flow of vapor and liquid is generally parallel to the axes of the flow passageways. The feed circuit heat and mass transfer fin section extends to the bottom of the dephlegmator core, and the feed circuit is open at the bottom and is in full flow communication with the interior of pressure vessel 3. Thus vapor can flow into the core while liquid drains from the core without flow restriction, and the full fluid-handling capacity of the core can be utilized.

A stream of mixed feed gas 5 enters inlet 7 of pressure vessel 3 and flows into the open bottom end of and upward through the feed circuit of dephlegmator 1. The feed gas is partially condensed therein by refrigeration provided in adjacent flow channels as described below, and rectification occurs as vapor flows upward while exchanging heat and mass with downward flowing liquid. Condensate drains freely from the feed circuit at the bottom of the core and condensed liquid 9 collects in the bottom of the vessel, from which liquid product stream 11 is withdrawn through vessel outlet 13. Uncondensed vapor exits dephlegmator 1 via header 15 and line 17, and flows through vessel outlet 19 to provide vapor product stream 21. Header 15, shown here schematically, is in flow communication with all flow passageways of the feed circuit at the top of dephlegmator 1. Conventional distributors can be used at the outlet of the feed circuit to collect the uncondensed vapor into header 15.

Vapor product stream 21 is enriched in the lower boiling, more volatile components in the feed gas mixture and liquid product 11 is enriched in the higher boiling, less volatile components in the feed gas mixture. The feed gas mixture can contain components selected from hydrogen, helium, nitrogen, carbon monoxide, carbon dioxide, oxygen, and $C_1$ to $C_6$ hydrocarbons. Feed gas mixtures can include cracked gas, refinery and petrochemical plant offgases, synthesis gas, and natural gas.

Typical refrigerant stream 23 is introduced via vessel inlet 25, line 27, and header 29 into a refrigerant circuit which comprises a group of flow channels in the core of dephlegmator 1. Header 29, shown here schematically, is in flow communication with all flow passageways of the refrigerant circuit at the top of dephlegmator 1. Refrigerant flows downward through the refrigerant circuit while warming and/or vaporizing to provide indirect cooling to the condensing vapor in the feed circuit. Warmed refrigerant is withdrawn from the bottom of dephlegmator 1 via header 31, line 33, and vessel outlet 35. Header 31, shown here schematically, is in flow communication with all flow passageways of the refrigerant circuit at the bottom of dephlegmator 1. Conventional distributors are typically used at the inlet and outlet of the refrigeration circuit to distribute and collect refrigerant in headers 29 and 31 respectively.

Refrigerant 23 can be a cold process fluid which is warmed to provide sensible and/or latent heat for cooling and condensing the feed gas. Alternatively, a liquid refrigerant can be used which vaporizes while flowing through the refrigerant circuit. The liquid refrigerant also may flow upward, such as in a thermosiphon arrangement. Typical refrigerants are C1 to C3 hydrocarbons, ammonia, fluorocarbons, and chlorofluorocarbons. More than one refrigerant circuit can be used if desired, which would require additional header and distributor systems at the top and bottom of the dephlegmator.

Additional dephlegmators can be installed in parallel with dephlegmator 1 in pressure vessel 3 if desired. An additional dephlegmator 37, for example, is shown in FIG. 1 and operates in parallel with dephlegmator 1. Header 39 is used to withdraw uncondensed vapor from dephlegmator 37; headers 41 and 43 are used to introduce and withdraw refrigerant respectively.

Typical operating temperatures and pressures range from +50 to −300° F. for feed and refrigerants, 100 to 800 psia for the feed, and 2 to 500 psia for refrigerants.

When parallel dephlegmator cores are used, inlet and outlet lines can be manifolded inside pressure vessel 3 as shown to reduce the number of pipes passing through the vessel shell, although this is not necessary. Refrigerant drums, which may be used for ethylene, propylene, or similar thermosiphon-type refrigerant circuits, or for distributing two-phase refrigerant streams into the dephlegmator core, can be located inside or outside the pressure vessel as desired. The pressure vessel can be externally insulated, similar to a distillation column, so that no cold box is required, particularly where operating temperatures are above about −250° F.

Figure 2:
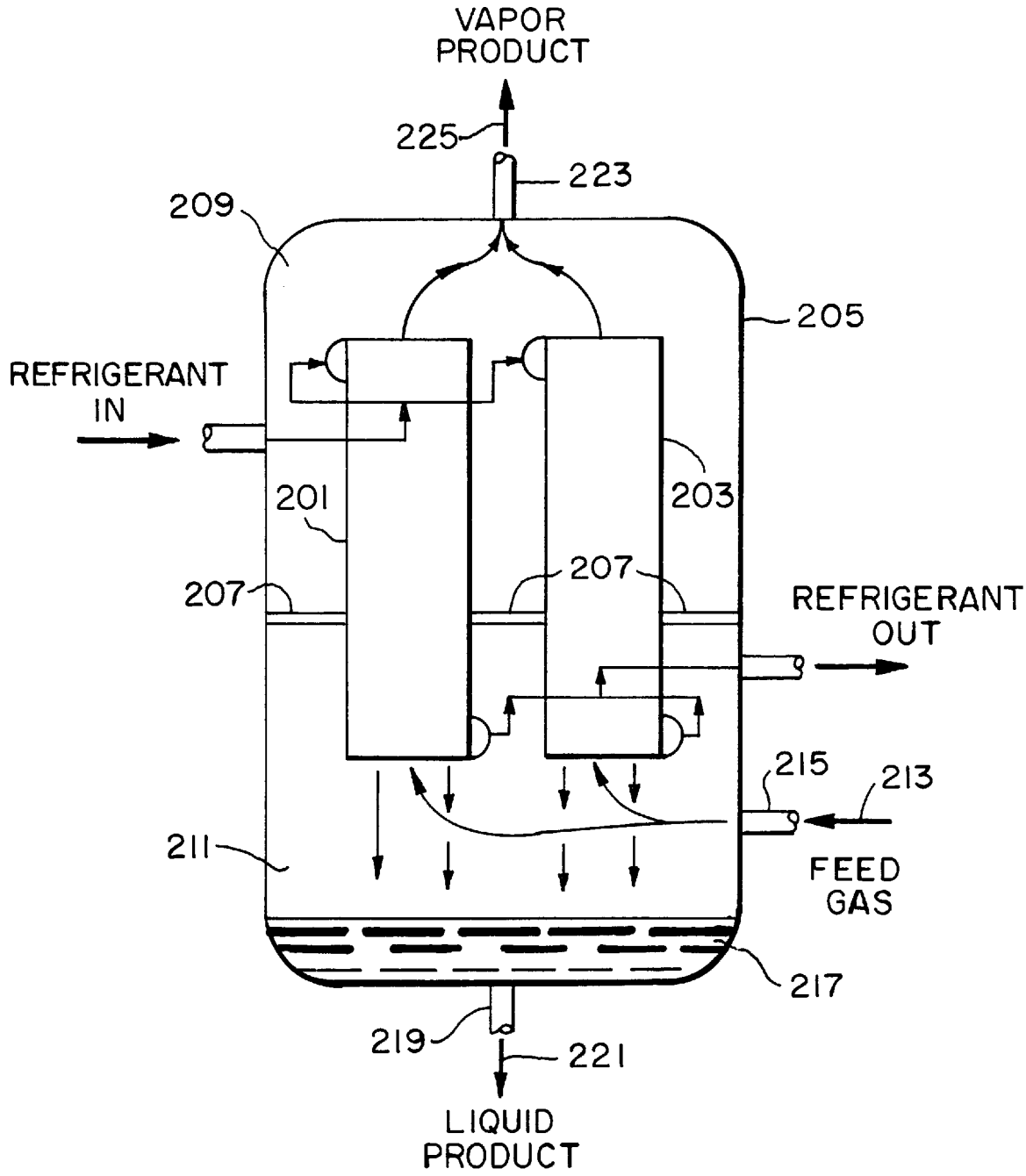
FIG. 2 is a schematic illustration of an alternative embodiment of the dephlegmator according to the present invention.

An alternative embodiment of the invention is shown in FIG. 2 which illustrates the use of two dephlegmators in parallel, although single or multiple dephlegmators can be used if desired. In this embodiment, dephlegmators 201 and 203 are installed in pressure vessel 205, and seal 207 (shown schematically) is installed between the dephlegmator and pressure vessel walls to segregate the vessel interior into upper section 209 and lower section 211 which are not in flow communication. Seal 207 can be installed at any appropriate axial location between the upper and lower ends of dephlegmators 201 and 203. Seal 207 can be any type of seal known in the art for segregating the upper and lower sections of the vessel against a low gas pressure differential. Seal 207 could be integrated with a core or piping support member.

The use of seal 207 eliminates the need for feed circuit headers at the top of the dephlegmators, and the feed channels are thus open at both ends. The feed circuit heat and mass transfer fin can be continuous from the top to the bottom of the core, with no distributors or headers. The bottom end of each feed channel is in flow communication with lower section 211 of pressure vessel 205, and the upper end of each feed channel is in flow communication with upper section 209 of the pressure vessel. The refrigerant circuits are similar to those described in FIG. 1.

In this embodiment, feed gas stream 213 flows through vessel inlet 215 into lower section 211 of vessel 205 and upward through the feed channels of dephlegmators 201 and 203. Condensate flows from the feed channels to form liquid 217 in the bottom of the vessel, which is withdrawn via vessel outlet 219 to provide liquid product 221. Uncondensed vapor flows directly from the open feed channels at the upper ends of the dephlegmators and is withdrawn via vessel outlet 223 to provide vapor product 225.

Figure 3:
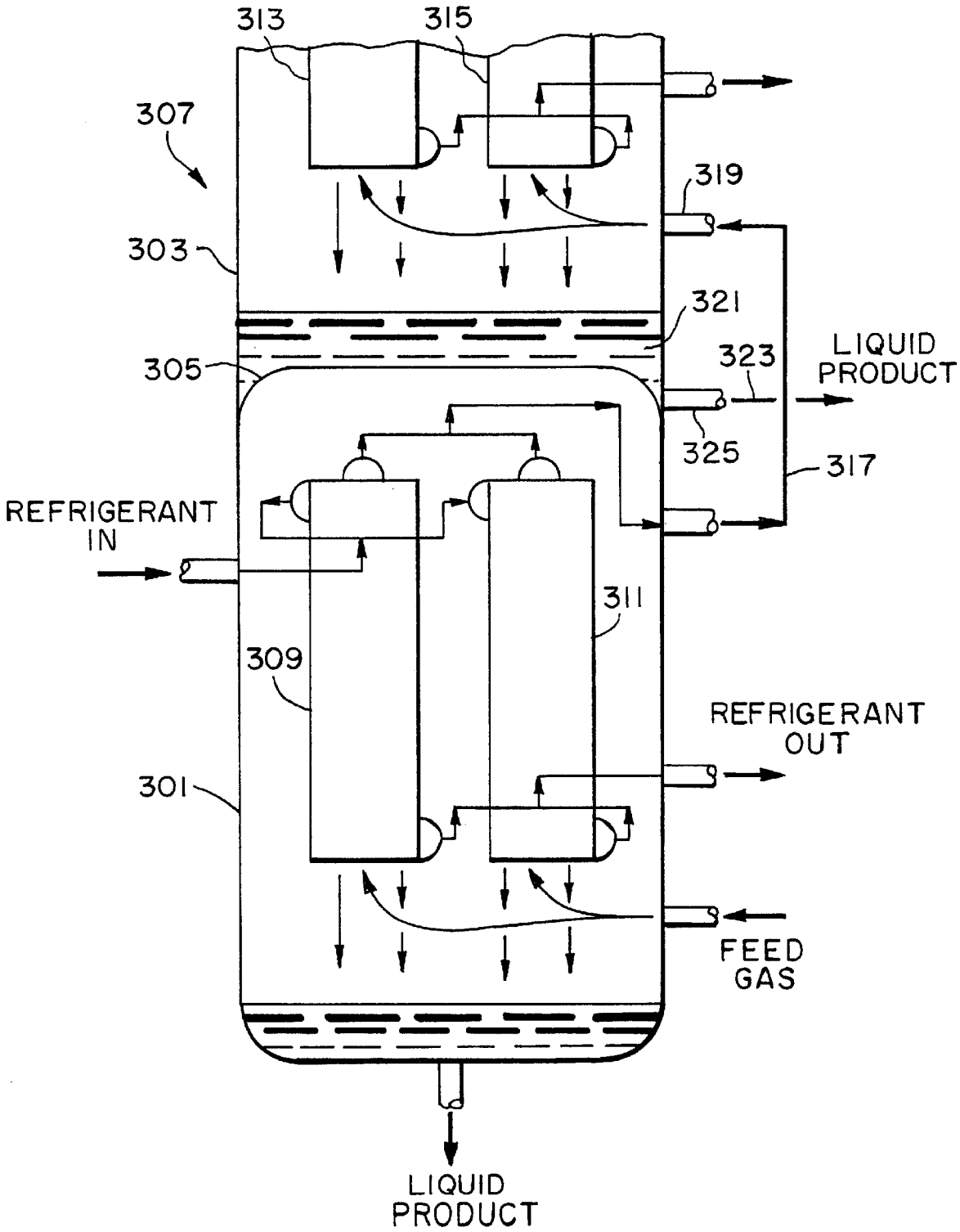
FIG. 3 is a schematic illustration of another alternative embodiment of the dephlegmator according to the present invention.

Two or more dephlegmator cores operating in different temperature ranges can be utilized in series by stacking the pressure vessels in a vertical arrangement or by locating the vessels side-by-side. An internal head can be used inside a single pressure vessel to separate the warmer and colder dephlegmators as shown in the alternative embodiment of FIG. 3. In this embodiment, lower pressure vessel section 301 and upper pressure vessel section 303 are formed by head 305 installed in overall pressure vessel 307 (shown partially). Lower pressure vessel 301 and dephlegmators 309 and 311 installed therein are similar to the system of FIG. 1. Dephlegmators 313 and 315 (shown partially) installed in upper pressure vessel 303 are similar to dephlegmators 309 and 311. Vapor product 317 from dephlegmators 309 and 311 flows through vessel inlet 319 into upper pressure vessel 303, and then flows upward through dephlegmators 313 and 315. Vapor condenses further in dephlegmators 313 and 315, which operate with a colder refrigerant than dephlegmators 309 and 311.

Additional liquid is condensed, flows out of the bottom of dephlegmators 313 and 315, and collects as liquid 321. Second liquid product stream 323, which contains additional higher boiling components, is withdrawn through vessel outlet 325. A vapor product is withdrawn from the top of upper pressure vessel 303 (not shown) and is further enriched in the more volatile components in the feed gas.

The two sections of vessel 307 do not necessarily utilize the same number or size of dephlegmators, and the sections may be of different diameters. Three or more dephlegmators, each operating at progressively colder temperatures, can be installed in series within a single pressure vessel if desired.

Figure 4:
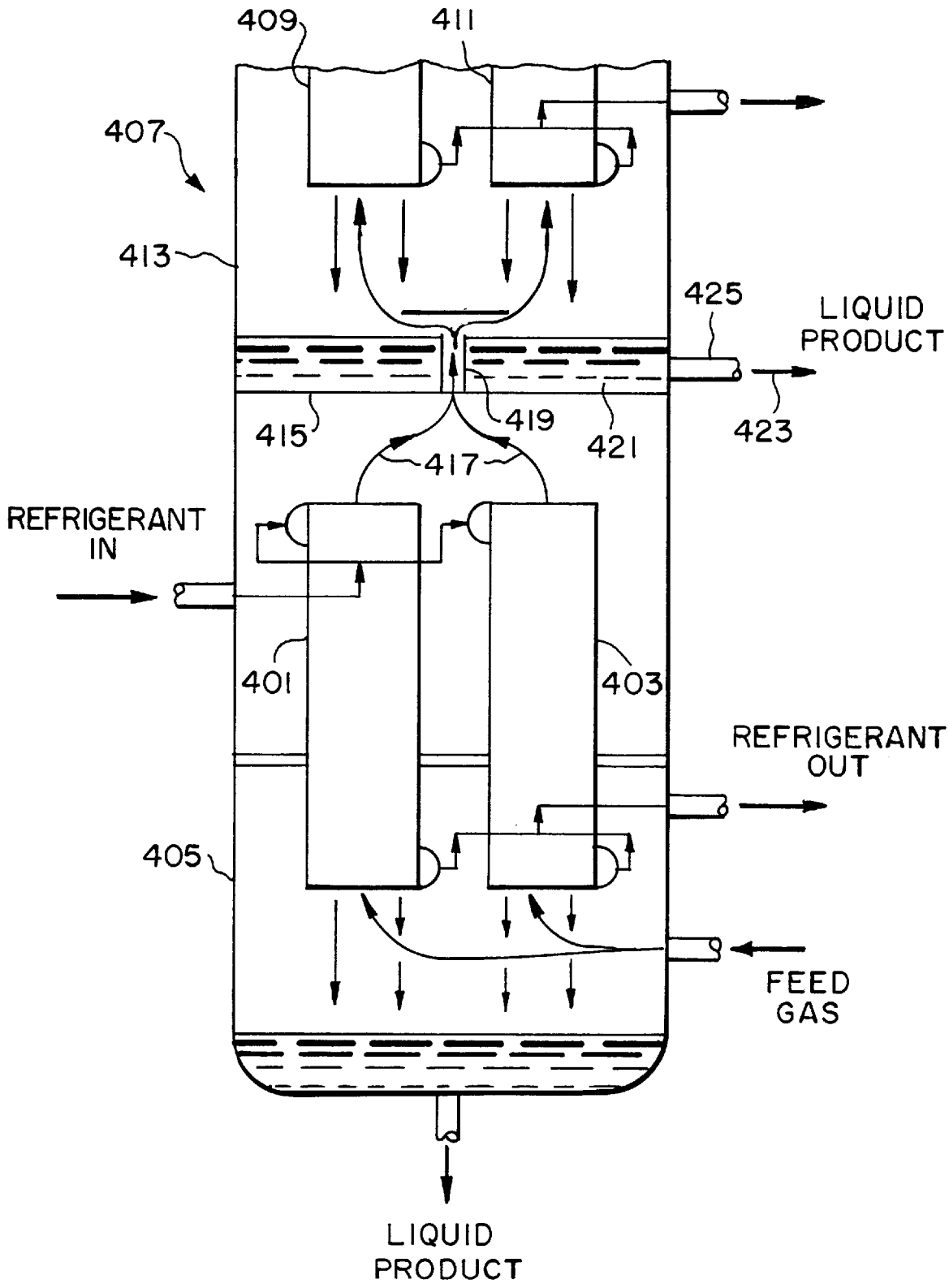
FIG. 4 is a schematic illustration of yet another alternative embodiment of the dephlegmator according to the present invention.

Another embodiment of the invention is illustrated in FIG. 4. In this embodiment, two sets of the dephlegmator assemblies similar to those of FIG. 2 are arranged in series in a single pressure vessel. Dephlegmators 401 and 403 are installed in lower section 405 of pressure vessel 407 (shown partially). Additional similar dephlegmators 409 and 411 (shown partially) are installed in upper section 413 of pressure vessel 407. Sections 405 and 413 of pressure vessel 407 are separated by chimney tray 415, which allows passage of uncondensed vapor 417 from the lower dephlegmators 401 and 403 via chimney 419 into upper section 413. Chimney tray 415 collects condensate liquid 421 from dephlegmators 409 and 411, and liquid product 423 is withdrawn through vessel outlet 425. Dephlegmators 401 and 403, as well as dephlegmators 409 and 411, operate in a similar manner as dephlegmators 201 and 203 of FIG. 2.

The two sections of vessel 407 can contain different numbers or sizes of dephlegmators, and the sections may be of different diameters. Three or more dephlegmators, each operating at progressively colder temperatures, can be installed in series within a single pressure vessel if desired.

The dephlegmators in all embodiments described above can be any type of heat exchangers known in the art which can operate in the condensing mode as described. Preferably, the dephlegmators are of the well-known plate and fin type in which a plurality of parting sheets separated by fins of various shapes are brazed together into a single assembly. Manifolds, headers, and distributors can be any of those known in the art. Alternatively, the dephlegmators can be of the shell and tube type. Other types of devices with multiple vertical or near-vertical flow channels can be envisioned which perform the same role as the configurations described above. The present invention is not limited to any specific type of dephlegmator, and requires only that (1) the dephlegmator or dephlegmators be installed inside of a pressure vessel or vessels, and (2) the bottom of each feed circuit in each dephlegmator be open and in direct flow communication with the interior of the pressure vessel. Optionally, the top of each feed circuit also can be open and in flow communication with interior sections of the pressure vessel when upper and lower sections of the vessel are separated by sealing means.

As described above, multiple dephlegmator cores in the present invention can be operated in parallel or in series or a combination of both. Unlike the complex manifolding required in prior art systems, no manifolding is needed for the vapor entering and condensate exiting the feed circuit at the bottom of a dephlegmator core. This prior art manifolding, along with associated nozzles and headers, must be very large in order to prevent flooding of the dephlegmator by entrainment of the draining liquid into the entering feed vapor.

The pressure vessel for the present invention can be designed to operate at any pressure level, preferably in the range of 150 to 800 psia. Conventional full dome headers and similar integrated vessels cannot be utilized at pressures above about 150 psig. The dephlegmator cores can be any size, both in cross-section and in length. Welded-blocks, i.e. two or more cores welded together side-by-side, can be utilized to increase the available cross-section of the individual dephlegmator cores to a very large size, such as 4 feet by 8 feet or more. Any length of core can be used, and is typically in the range of 5 to 20 feet.

The pressure vessel can be externally insulated, similar to a distillation column, so that no cold box is required for the dephlegmators. When parallel dephlegmator cores are used, the number of pipes which must pass through the pressure vessel shell can be minimized by manifolding refrigerant stream nozzles inside the pressure vessel. Refrigerant drums can also be located either inside or outside the pressure vessel, as desired.

Thus the present invention simplifies the design of dephlegmator cores which operate in the condensing mode and allows efficient use of the core cross section because no manifolds, distributors, or collectors are required at the bottom of each feed circuit. In an optional embodiment, vapor collectors are not required at the top of each feed circuit, further simplifying dephlegmator design and operation. The present invention allows operation of dephlegmators at higher pressures than many prior art systems which require dome headers and similar integrated vessels attached to the dephlegmator feed circuits. In addition, higher throughput is possible because the available flow area and fluid handling capacity of each dephlegmator are fully utilized.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A system for the separation of a feed gas mixture containing at least one more volatile component and at least one less volatile component, which system comprises:

(a) a pressure vessel having an interior and an exterior;

(b) a dephlegmator installed in the interior of the pressure vessel, wherein the dephlegmator comprises a group of flow passageways, each passageway having an upper end and a lower end, and wherein the lower ends of the flow passageways are open and are in flow communication with the interior of the pressure vessel;

(c) at least one vapor header in flow communication with the upper ends of the flow passageways, and piping means for withdrawing a vapor product enriched in the more volatile component from the vapor header to the exterior of the pressure vessel;

(d) piping means for introducing the feed gas mixture into the interior of the pressure vessel; and (e) piping means for withdrawing from the interior of the pressure vessel a liquid product enriched in the less volatile component.

2. The system of claim 1 which further comprises:

(f) one or more additional groups of flow passageways in the dephlegmator wherein each of the flow passageways has an upper end and a lower end, and wherein the group of additional flow passageways is in indirect heat transfer communication with the group of flow passageways of (b);

(g) an upper header in flow communication with the upper ends of the flow passageways of (f) and a lower header in flow communication with the lower ends of the flow passageways of (f); and (h) piping means for introducing refrigerant from the exterior of the pressure vessel into one header of (g) and piping means for withdrawing refrigerant from the other header of (g) to the exterior of the pressure vessel.

3. The system of claim 1 wherein the dephlegmator is constructed in a plate and fin configuration.

4. The system of claim 1 wherein the dephlegmator is constructed in a shell and tube configuration.

5. The system of claim 1 which further comprises one or more additional dephlegmators installed in the pressure vessel and configured to operate in parallel with the dephlegmator of (b).

6. The system of claim 1 which further comprises:

(f) an additional pressure vessel having an interior and an exterior;

(g) an additional dephlegmator installed in the interior of the additional pressure vessel, wherein the additional dephlegmator comprises a group of flow passageways, each passageway having an upper end and a lower end, and wherein the lower ends of the flow passageways are open and are in flow communication with the interior of the additional pressure vessel;

(h) at least one vapor header in flow communication with the upper ends of the flow passageways, and piping means for withdrawing a vapor product further enriched in the more volatile component from the vapor header to the exterior of the additional pressure vessel;

(i) piping means for transferring the vapor product of (c) from the pressure vessel of (a) into the interior of the additional pressure vessel of (f); and (j) piping means for withdrawing from the interior of the additional pressure vessel an additional liquid product enriched in the less volatile component.

7. The system of claim 6 which further comprises:

(k) one or more groups of additional flow passageways in the additional dephlegmator wherein each of the flow passageways has an upper end and a lower end, and wherein the group of additional flow passageways is in indirect heat transfer communication with the group of flow passageways of (g);

(l) an upper header in flow communication with the upper ends of the flow passageways of (k) and a lower header in flow communication with the lower ends of the flow passageways of (k); and (m) piping means for introducing refrigerant from the exterior of the additional pressure vessel into one header of (l) and piping means for withdrawing refrigerant from the other header of (l) to the exterior of the additional pressure vessel.

8. A system for the separation of a feed gas mixture containing at least one more volatile component and at least one less volatile component, which system comprises:

(a) a pressure vessel having an interior and an exterior;

(b) a dephlegmator installed in the interior of the pressure vessel, wherein the dephlegmator comprises a group of flow passageways, each passageway having an upper end and a lower end, and wherein the upper and lower ends of the flow passageways are open and are in flow communication with the interior of the pressure vessel;

(c) seal means disposed in the pressure vessel at an axial location between the upper and lower ends of the flow passageways wherein the seal means divides the interior of the pressure vessel into an upper section and a lower section which are not in flow communication, wherein the upper ends of the flow passageways are in flow communication with the upper section of the pressure vessel and the lower ends of the flow passageways are in flow communication with the lower section of the pressure vessel;

(d) piping means for introducing the feed gas mixture into the lower section of the pressure vessel;

(e) piping means for withdrawing a vapor product enriched in the more volatile component from upper section of the pressure vessel; and (f) piping means for withdrawing from the lower section of the pressure vessel a liquid product enriched in the less volatile component.

9. The system of claim 8 which further comprises:

(g) one or more additional groups of flow passageways in the dephlegmator wherein the each of the flow passageways has an upper end and a lower end, and wherein the group of additional flow passageways is in indirect heat transfer communication with the group of flow passageways of (b);

(h) an upper header in flow communication with the upper ends of the flow passageways of (g) and a lower header in flow communication with the lower ends of the flow passageways of (g); and (i) piping means for introducing refrigerant from the exterior of the pressure vessel into one header of (h) and piping means for withdrawing refrigerant from the other header of (h) to the exterior of the pressure vessel.

10. The system of claim 8 wherein the dephlegmator is constructed in a plate and fin configuration.

11. The system of claim 8 wherein the dephlegmator is constructed in a shell and tube configuration.

12. The system of claim 8 which further comprises an additional dephlegmator installed in the pressure vessel and configured to operate in parallel with the dephlegmator of (b).

13. The system of claim 8 which further comprises:

(g) an additional pressure vessel having an interior and an exterior;

(h) an additional dephlegmator installed in the interior of the additional pressure vessel, wherein the dephlegmator comprises a group of flow passageways, each passageway having an upper end and a lower end, and wherein the upper and lower ends of the flow passageways are open and are in flow communication with the interior of the pressure vessel;

(i) seal means disposed in the additional pressure vessel at an axial location between the upper and lower ends of the flow passageways, which seal means divides the interior of the additional pressure vessel into an upper section and a lower section which are not in flow communication, wherein the upper ends of the flow passageway are in flow communication with the upper section of the pressure vessel and the lower ends of the flow passageways are in flow communication with the lower section of the pressure vessel;

(j) means for transferring the vapor product of (e) from the upper section of the pressure vessel into the lower section of the additional pressure vessel;

(k) piping means for withdrawing a vapor product further enriched in the more volatile component from upper section of the additional pressure vessel; and (l) piping means for withdrawing from the lower section of the additional pressure vessel a liquid product enriched in the less volatile component.

14. A method for the separation of a feed gas mixture containing at least one more volatile component and at least one less volatile component which comprises:

(a) providing a pressure vessel having an interior and an exterior;

(b) providing a dephlegmator installed in the interior of the pressure vessel, wherein the dephlegmator comprises a group of flow passageways, each passageway having an upper end and a lower end, and wherein the lower ends of the flow passageways are open and are in flow communication with the interior of the pressure vessel;

(c) introducing the feed gas mixture into the interior of the pressure vessel;

(d) passing the feed gas mixture upwardly through the flow passageways and condensing therein at least a portion of the less volatile components by indirect heat transfer with one or more refrigerants, wherein the condensate so formed flows downward in heat and mass transfer relation with upward flowing vapor and collects in the bottom of the pressure vessel;

(e) providing at least one vapor header in flow communication with the upper ends of the flow passageways and withdrawing a vapor product enriched in the more volatile component from the vapor header to the exterior of the pressure vessel; and (f) withdrawing from the interior of the pressure vessel a liquid product enriched in the less volatile component.

15. The method of claim 14 wherein the feed gas comprises two or more components selected from the group consisting of hydrogen, helium, nitrogen, carbon monoxide, carbon dioxide, oxygen, and hydrocarbons having from one to six carbon atoms.

16. A method for the separation of a feed gas mixture containing at least one more volatile component and at least one less volatile component which comprises:

(a) providing a pressure vessel having an interior and an exterior;

(b) providing a dephlegmator installed in the interior of the pressure vessel, wherein the dephlegmator comprises a group of flow passageways, each passageway having an upper end and a lower end, and wherein the upper and lower ends of the flow passageways are open and are in flow communication with the interior of the pressure vessel;

(c) providing seal means disposed in the pressure vessel at an axial location between the upper and lower ends of the flow passageways wherein the seal means divides the interior of the pressure vessel into an upper section and a lower section which are not in flow communication, wherein the upper ends of the flow passageways are in flow communication with the upper section of the pressure vessel and the lower ends of the flow passageways are in flow communication with the lower section of the pressure vessel;

(d) introducing the feed gas mixture into the lower section of the pressure vessel;

(e) passing the feed gas mixture upwardly through the flow passageways and condensing therein at least a portion of the less volatile component by indirect heat transfer with one or more refrigerants, wherein the condensate so formed flows downward in heat and mass transfer relation with upward flowing vapor and collects in the bottom of the pressure vessel;

(f) withdrawing a vapor product enriched in the more volatile component from upper section of the pressure vessel; and (g) withdrawing a liquid product enriched in the less volatile component from the lower section of the pressure vessel.

17. The method of claim 16 wherein the feed gas comprises two or more components selected from the group consisting of hydrogen, helium, nitrogen, carbon monoxide, carbon dioxide, oxygen, and hydrocarbons having from one to six carbon atoms.

* * * * *